US007023962B2

(12) United States Patent
Xu et al.

(10) Patent No.: US 7,023,962 B2
(45) Date of Patent: Apr. 4, 2006

(54) COLLIMATOR, X-RAY IRRADIATOR, AND X-RAY APPARATUS

(75) Inventors: Xiaodong Xu, Beijing (CN); Xiaojie Wang, Beijing (CN); Denis Perrillat, Paris (FR)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 0 days.

(21) Appl. No.: 10/982,114

(22) Filed: Nov. 4, 2004

(65) Prior Publication Data

US 2005/0111626 A1 May 26, 2005

(30) Foreign Application Priority Data

Nov. 20, 2003 (CN) ..... 200310124810 A

(51) Int. Cl.
*G21K 1/104* (2006.01)

(52) U.S. Cl. ..... 378/147; 378/150; 378/152

(58) Field of Classification Search ..... 378/147, 378/151, 152, 148–150, 153–155, 160–161, 378/62; 250/61.5, 519
See application file for complete search history.

(56) References Cited

U.S. PATENT DOCUMENTS 3,048,700 A * 8/1962 Koerner et al. ..... 378/152
3,668,402 A * 6/1972 Palermo et al. ..... 378/150
3,677,508 A * 7/1972 Dillard et al. ..... 244/172.7
4,200,803 A 4/1980 Becker et al.
4,277,685 A 7/1981 Covic et al.
4,638,166 A * 1/1987 Baudro ..... 250/515.1
5,436,958 A 7/1995 Taylor
5,438,454 A 8/1995 Ludewigt et al.
5,483,562 A * 1/1996 Kornfeldt et al. ..... 376/287
6,325,538 B1 * 12/2001 Heesch ..... 378/203
6,449,340 B1 9/2002 Tybinkowski et al.
6,788,764 B1 9/2004 Saladin et al.

FOREIGN PATENT DOCUMENTS

JP 2002-355242 12/2002

* cited by examiner

*Primary Examiner*—Allen C. Ho
*Assistant Examiner*—John M. Corbett
(74) *Attorney, Agent, or Firm*—Carl B. Horton, Esq.; Armstrong Teasdale LLP

(57) ABSTRACT

A collimator comprises a pair of first plate members having X-ray absorbability and a pair of second plate members having X-ray absorbability. The pair of first plate members are movable in a direction parallel to surfaces thereof, and have respective end faces opposed to each other with an X-ray passing aperture being defined by a spacing between the opposed end faces of the first plate members. The pair of second plate members are capable of being folded in a zigzag fashion through hinges, and in order to intercept other X-rays than the X-ray passing through the aperture, each of the second plate members is connected at one end thereof to each end of the first plate members on the side opposite to the opposed end faces of the first plate members and is connected at the other end thereof to each of fixing portions.

12 Claims, 5 Drawing Sheets

COLLIMATOR, X-RAY IRRADIATOR, AND X-RAY APPARATUS

CROSS REFERENCE TO RELATED APPLICATIONS

This application claims the benefit of Chinese Application No. 2003-10124810.X filed Nov. 20, 2003.

BACKGROUND OF THE INVENTION

The present invention relates to a collimator, an X-ray irradiator, and an X-ray apparatus. Particularly, the present invention is concerned with a collimator for defining an X-ray irradiation range, as well as an X-ray irradiator and an X-ray apparatus both provided with the collimator.

In an X-ray irradiator there is used a collimator for defining an X-ray irradiation range. The collimator has an aperture which permits the passage of X-ray therethrough. The other portion than the aperture of the collimator does not permit the passage of X-ray. The degree of opening of the aperture is changeable, whereby the X-ray irradiation range can be adjusted.

The collimator with such an adjustable aperture has movable plate members, i.e., blades, possessing X-ray absorbability. There are used a pair of blades having respective end faces opposed to each other. The pair of blades are movable in directions opposite to each other in a plane parallel to their surfaces. For widening the aperture, the pair of blades are moved in directions away from each other, while for narrowing the aperture, the pair of blades are moved toward each other.

For reducing the collimator size without sacrificing the adjustable range of the aperture, there has been proposed an X-ray irradiator wherein blades are constructed of a flexible material and are wound onto drums to widen the aperture, while they are delivered from the drums to narrow the aperture (see, for example, Patent Document 1).

[Patent Document] Japanese Published Unexamined Patent Application No. 2002-355242 (pages 2–3, FIGS. 1–2)

In the above conventional collimator there is the problem that a special material which is flexible and superior in X-ray absorbability must be used as the blade material.

SUMMARY OF THE INVENTION

Accordingly, it is an object of the present invention to provide a collimator which can be reduced in size without using any special material and without sacrificing an adjustable range of an aperture, as well as an X-ray irradiator and an X-ray apparatus both provided with such a collimator.

(1) In one aspect of the present invention for solving the above-mentioned problem there is provided a collimator comprising: a pair of first plate members having X-ray absorbability, movable in a direction parallel to surfaces thereof, and having respective end faces opposed to each other, with an X-ray passing aperture being defined by a spacing between the opposed end faces of the first plate members; and a pair of second plate members each of which has X-ray absorbability, is capable of being folded in a zigzag fashion through hinges, and is connected at one end thereof to an end of each of the pair of first plate members on the side opposite to the opposed end faces of the first plate members and connected at the other end thereof to a fixing portion in order to intercept other X-rays than the X-ray passing through the aperture.

(2) In another aspect of the present invention for solving the above-mentioned problem there is provided an X-ray irradiator comprising an X-ray tube and a collimator for collimating X-ray emitted from the X-ray tube. The collimator comprises: a pair of first plate members having X-ray absorbability, movable in a direction parallel to surfaces thereof, and having respective end faces opposed to each other, with an X-ray passing aperture being defined by a spacing between the opposed end faces of the first plate members; and a pair of second plate members each of which has X-ray absorbability, is capable of being folded in a zigzag fashion through hinges, and is connected at one end thereof to an end of each of the pair of first plate members on the side opposite to the opposed end faces of the first plate members and connected at the other end thereof to a fixing portion in order to intercept other X-rays than the X-ray passing through the aperture.

(3) In a further aspect of the present invention for solving the above-mentioned problem there is provided an X-ray apparatus comprising an X-ray tube, a collimator for collimating X-ray emitted from the X-ray tube and applying the collimated X-ray to an object to be radiographed, and a detector means for detecting the X-ray which has passed through the object to be radiographed. The collimator comprises: a pair of first plate members having X-ray absorbability, movable in a direction parallel to surfaces thereof, and having respective end faces opposed to each other, with an X-ray passing aperture being defined by a spacing between the opposed end faces of the first plate members; and a pair of second plate members each of which has X-ray absorbability, is capable of being folded in a zigzag fashion through hinges, and is connected at one end thereof to an end of each of the pair of first plate members on the side opposite to the opposed end faces of the first plate members and connected at the other end thereof to a fixing portion in order to intercept other X-rays than the X-ray passing through the aperture.

In the above aspects of the present invention, since the second plate members which constitute blades together with the first plate members can be folded in a zigzag fashion through hinges, it is possible to reduce an external size of the collimator without using any special material such as a flexible X-ray absorbing material and without sacrificing an adjustable range of the aperture.

In the above aspects of the present invention it is preferable, in point of defining an X-ray irradiation range in two directions perpendicular to each other, that the collimator further comprise: a pair of third plate members having X-ray absorbability, being movable in a direction parallel to surfaces thereof and perpendicular to the moving direction of the first plate members, and having respective end faces opposed to each other, with an X-ray passing aperture being defined by a spacing between the opposed end faces of the third plate members; and a pair of fourth plate members each of which has X-ray absorbability, is capable of being folded in a zigzag fashion through hinges, and is connected at one end thereof to and end of each of the third pair of plate members on the side opposite to the opposed end faces of the third plate members and connected at the other end thereof to a fixing portion in order to intercept other X-rays than the X-ray passing through the aperture.

In point of increasing the degree of freedom in setting an irradiation range in the moving direction of the pair of first plate members, it is preferable that the pair of first plate members be movable independently of each other. Likewise, in point of increasing the degree of freedom in setting an irradiation range in the moving direction of the pair of third plate members, it is preferable that the pair of third plate members be movable independently of each other.

According to the present invention, it is possible to provide a collimator capable of being reduced in size without using any special material and without sacrificing the aperture, as well as an X-ray irradiator and an X-ray apparatus provided with the collimator.

Further objects and advantages of the present invention will be apparent from the following description of the preferred embodiments of the invention as illustrated in the accompanying drawings.

DETAILED DESCRIPTION OF THE INVENTION

Figure 1:
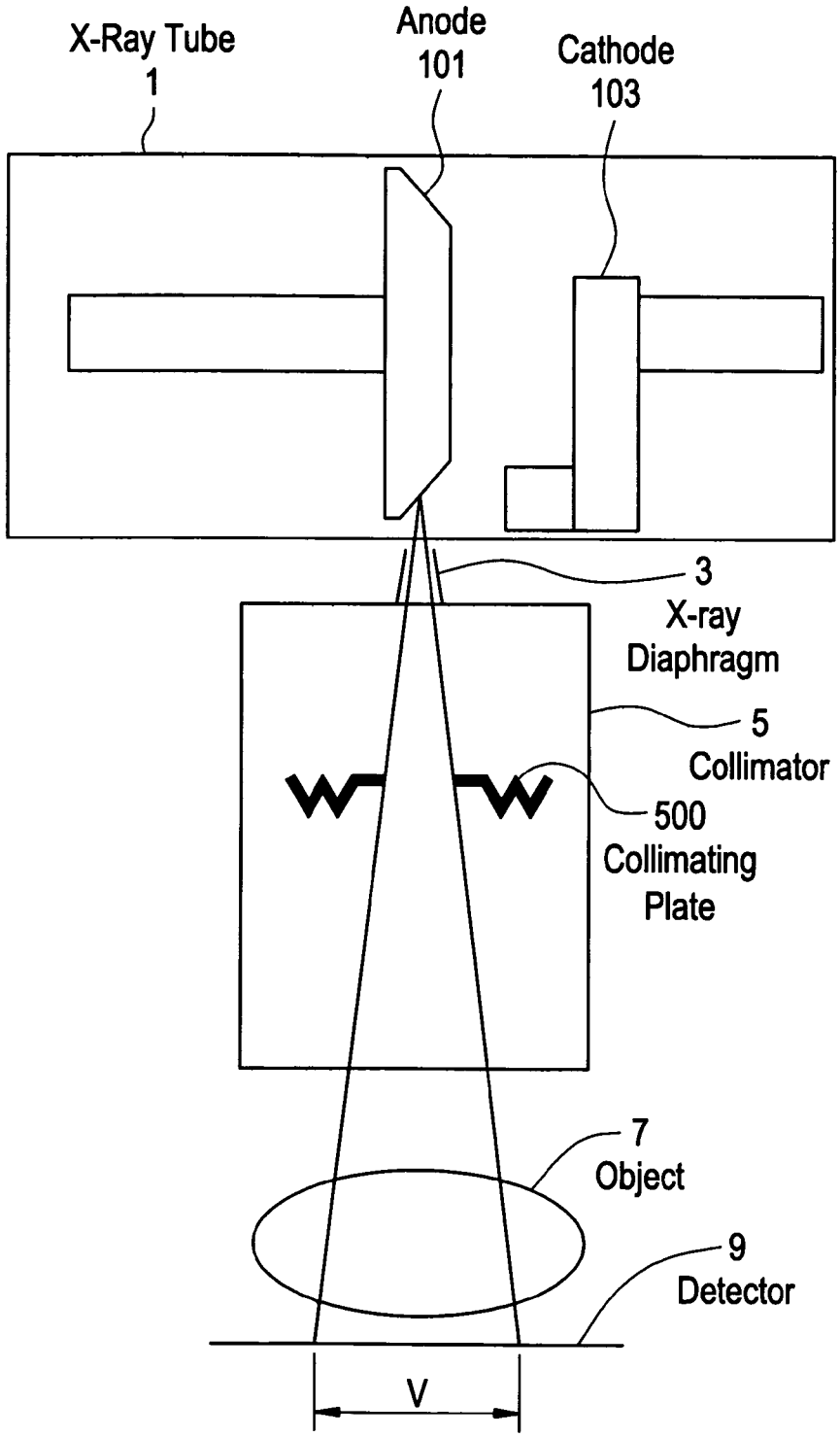
FIG. 1 illustrates a schematic construction of an X-ray apparatus.

An embodiment of the present invention will be described in detail hereinunder with reference to the accompanying drawings, provided the invention is not limited to the embodiment. FIG. 1 illustrates a schematic construction of an X-ray apparatus according to an embodiment of the present invention. With the construction of this apparatus, there is shown a working example of the apparatus according to the present invention.

In the X-ray apparatus, as shown in the same figure, X-ray emitted from an X-ray tube 1 is diaphragmed by an X-ray diaphragm 3 and is collimated by a collimating plate 500 disposed within a collimator 5, then the collimated X-ray is directed to an object 7 to be radiographed and the X-ray which has passed through the object 7 is detected by a detector 9. The X-ray tube 1 is a working example of the X-ray used in the present invention. The collimator 5 is a working example of the collimator used in the present invention. The detector 9 is a working example of the detector used in the present invention.

The portion consisting of the X-ray tube 1, X-ray diaphragm 3 and collimator 5 is a working example of the X-ray irradiator according to the present invention. With the construction of this portion there is shown a working example of the X-ray irradiator according to the present invention. The collimator 5 is a working example of the collimator used in the present invention. With the construction of the portion in question there is shown a working example of the collimator used in the present invention.

The X-ray tube 1 has an anode 101 and a cathode 103, and X-ray is emitted from a collision point (focal point) of electrons which are emitted from the cathode 103 toward the anode 101. The X-ray thus emitted passes through the X-ray diaphragm 3 and the collimator 5 and is incident on an object to be radiographed. The X-ray diaphragm 3 is constructed of an X-ray absorbing material such as lead for example. The collimating plate 500 of the collimator 5 is also constructed of an X-ray absorbing material such as lead for example.

The X-ray diaphragm 3 shapes the X-ray emitted from the X-ray tube 1 into a pyramidal beam with the X-ray focus on the anode 101 as a vertex. With an aperture formed by the collimating plate 500 of the collimator 5 there is defined an X-ray irradiation field. The aperture is changeable, whereby the X-ray irradiation field V is adjusted.

Figure 2:
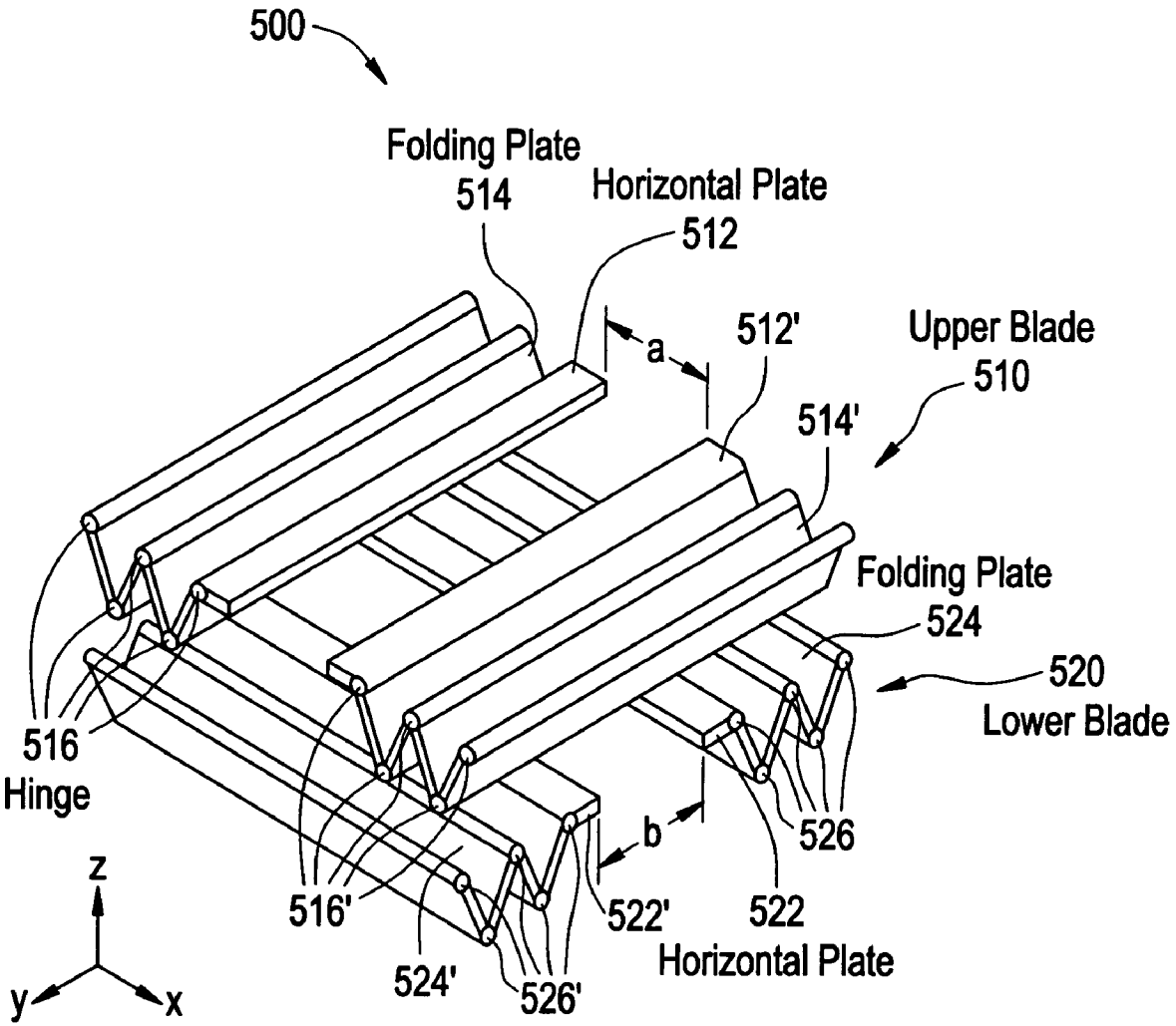
FIG. 2 illustrates the construction of a principal portion of a collimating plate.

A description will now be given of the collimating plate 500 in the collimator 5. FIG. 2 illustrates the construction of a principal portion of the collimating plate 500. As shown in the same figure, the collimating plate 500 has an upper blade 510 and a lower blade 520 which are respectively disposed in two upper and lower stages. In the same figure, three directions perpendicular to one another are assumed to be x, y, and z, of which z represents the vertical direction. X-ray is radiated from above.

The upper blade 510 has a pair of horizontal plates 512 and 512'. The horizontal plates 512 and 512' are rectangular plates and are constructed of an X-ray absorbing material such as lead for example. The horizontal plates 512 and 512' lie on one and same horizontal plane and their longs sides are parallel to each other, while their corresponding pairs of short sides each lie on one and same straight line. The horizontal plates 512 and 512' are displaceable in the direction of their short sides (in x direction), whereby the distance "a" between their end faces opposed to each other can be adjusted. The horizontal plates 512 and 512' are a working example of the first plate members used in the present invention.

Figure 3:
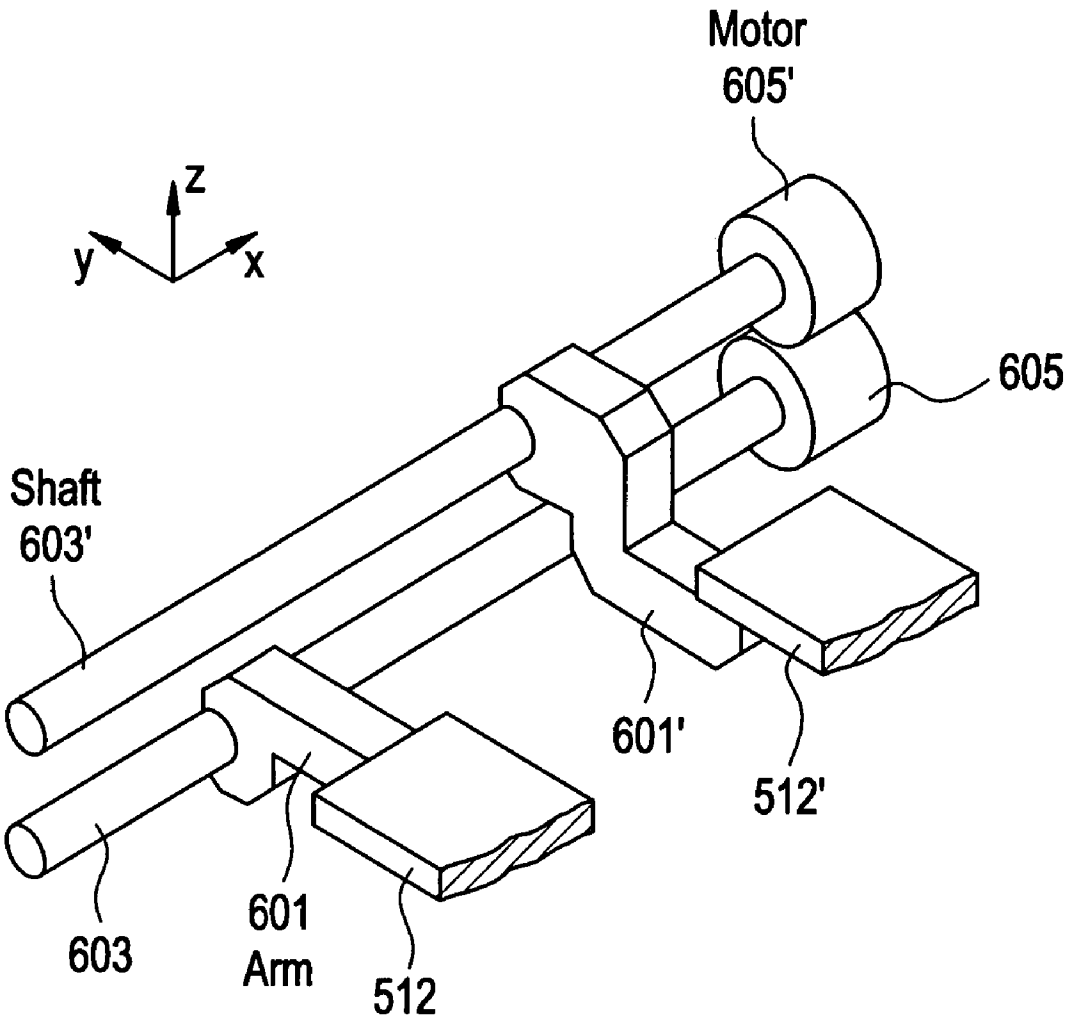
FIG. 3 illustrates the construction of a drive mechanism.

The horizontal plates 512 and 512' are positionally adjustable each independently. An example of a drive mechanism which enables such a positional adjustment is shown in FIG. 3. As shown in the same figure, the horizontal plates 512 and 512' are provided with arms 601 and 601', respectively, which extend in y direction. End portions of the arms 601 and 601' are engaged with shafts 603 and 603', respectively.

The shafts 603 and 603' are parallel shafts extending in x direction and are spaced from each other through a predetermined spacing in z direction. The arm 601' is bent in order to equalize the height in z direction of the horizontal plate 512' to that of the horizontal plate 512.

The shafts 603 and 603' are threaded throughout their overall lengths. The engaged portions of the arms 601 and 601' with the shafts 603 and 603' are internally threaded correspondingly. Motor 605 is mounted on one end of the shaft 603, and a motor 605' is mounted on one end of the shaft 603'. The motor 605 is capable of performing forward and reverse rotation. The motors 605 and 605' are controlled each independently by control means (not shown).

A pair of folding plates 514 and 514' are connected to the horizontal plates 512 and 512', respectively. One end of each of the folding plates 514 and 514' is connected respectively to each end face of the horizontal plates 512 and 512' on the side opposite to mutually opposed end faces of the horizontal plates, while the other end of each of the folding plates 514 and 514' is connected respectively to a fixing portion.

The pair of folding plates 514 and 514' are also constructed of an X-ray absorbing material such as lead for example. For example, the folding plates 514 and 514' are each constituted by a quadribent plate capable of being folded in a zigzag fashion. The number of bent portions is not limited to four, but may be any other appropriate number. The bent portions of the folding plates 514 and 514' are constituted by hinges 516 and 516'. The hinges 516 and 516' are also formed of such a material as lead, not permitting the passage of X-ray therethrough. The folding plates 514 and 514' are a working example of the second plate members used in the present invention.

Figure 4:
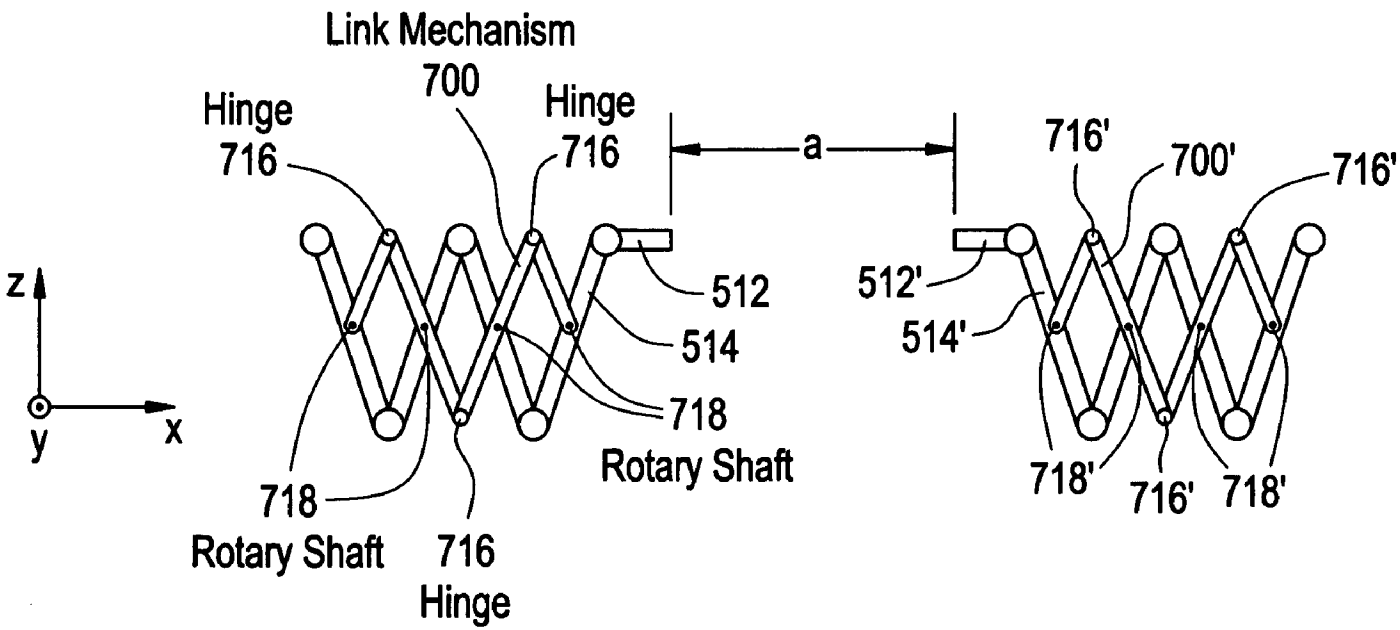
FIG. 4 illustrates the construction of a link mechanism.

The folding plates 514 and 514' are provided with link mechanisms at both end faces of the hinges, an example of which is shown in FIG. 4. As shown in the same figure, link mechanisms 700 and 700' are provided at one and opposite end faces of the folding plated 514 and 514'.

The link mechanisms 700 and 700' have bent portions symmetric with respect to the bent portions of the folding plates 514 and 514' and are mounted to the end faces of the folding plates 514 and 514' through rotary shafts 718 and 718' so as to be bent through the hinges 716 and 716'. With such link mechanisms 700 and 700', intermediate portions of the folding plates 514 and 514' are prevented from sagging.

The lower blade 520 also has the same construction as the upper blade 510. That is, the lower blade 520 has a pair of rectangular, horizontal plates 522 and 522' constructed of an X-ray absorbing material such as lead for example. The horizontal plates 522 and 522' lie on one and same horizontal plate and their long sides are parallel to each other, while their corresponding pairs of short sides each lie on one and same straight line.

The horizontal plane where the horizontal plates 522 and 522' are present underlies the horizontal plane where the horizontal plates 512 and 512' of the upper blade 510 are present. The direction of long sides of the horizontal plates 522 and 522' is perpendicular to the direction of long sides of the horizontal plates 512 and 512' of the upper blade 510.

The horizontal plates 522 and 522' are displaceable in their short side direction (y direction), whereby the distance "b" between their mutually opposed end faces can be adjusted. A positional adjustment for the horizontal plates 522 and 522' is done by a drive mechanism similar to that shown in FIG. 3. The horizontal plates 522 and 522' are a working example of the third plate members used in the present invention.

A pair of folding plates 524 and 524' are connected to the horizontal plates 522 and 522', respectively. More specifically, one end of each of the folding plates 524 and 524' is connected to an end face of each of the horizontal plates 522 and 522' on the side opposite to the mutually opposed end faces of the horizontal plates, while the other end of each of the folding plates 524 and 524' is connected respectively to a fixing portion.

The pair of folding plates 524 and 524' are also formed of an X-ray absorbing material such as lead for example. The folding plates 524 and 524' are constituted, for example, by a quadribent plate capable of being folded in a zigzag fashion. The number of such bent portions is not limited to four, but may be any other appropriate number. The bent portions of the folding plates 524 and 524' are constituted by hinges 526 and 526'. The hinges 526 and 526' are also formed of an X-ray absorbing material such as lead for example, not permitting the passage of X-ray therethrough. The folding plates 524 and 524' are a working example of the fourth plate members used in the present invention. The folding plates 524 and 524' are provided at both end faces of the hinges with link mechanisms similar to those shown in FIG. 4 to prevent sagging of their intermediate portions.

Figure 5:
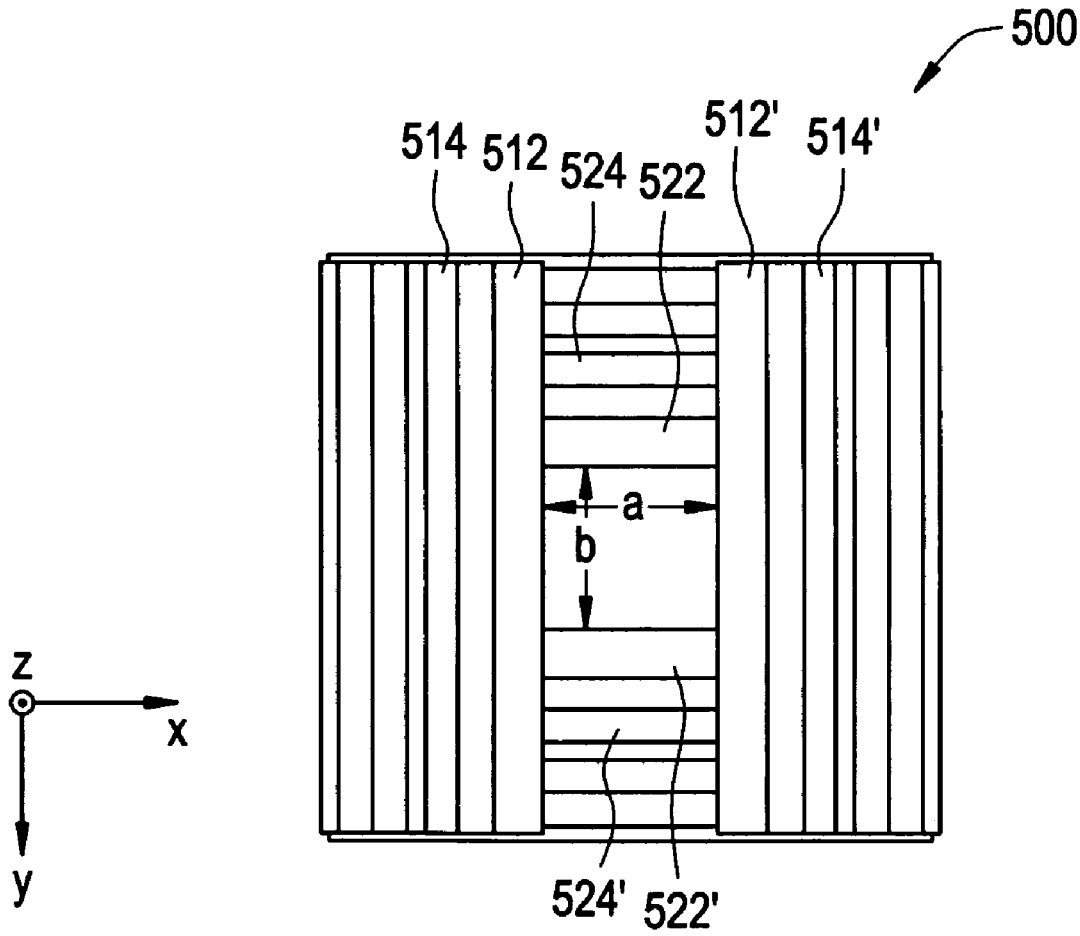
FIG. 5 illustrates in what state an aperture is formed.

With the collimating plate 500 of the above construction, such a quadrangular aperture having a size of "a×b" as shown in FIG. 5 is formed for the X-ray emitted from the X-ray tube 1. Since the positions of the four horizontal plates 512, 512', 522, and 522' can be changed each independently, the sizes a and b in both directions of the aperture can be adjusted each independently and a two-dimensional position of the aperture is also adjustable as desired.

In this case, since the folding plates 514, 514', 524, and 524' are adapted to expand and contract according to the positions of the horizontal plates 512, 512', 522, and 522', an external size of the collimating plate 500 does not increase even if the aperture is widened, thus permitting the reduction in size of the collimator. Besides, since the horizontal plates 512, 512', 522, 522' and the folding plates 514, 514', 524, 524' can both be fabricated by lead plates for example, there is not required any special material. In the case either the aperture size a or b may always be a fixed value, the plates on that side may be constituted, for example, by lead plates which define a fixed aperture.

Many widely different embodiments of the invention may be configured without departing from the spirit and the scope of the present invention. It should be understood that the present invention is not limited to the specific embodiments described in the specification, except as defined in the appended claims.

The invention claimed is:

1. A collimator comprising:

a pair of first plate members having X-ray absorbability, movable in a direction parallel to surfaces thereof, and having respective end faces opposed to each other, with an X-ray passing aperture being defined by a spacing between the opposed end faces of the first plate members; and a pair of second plate members each of which has X-ray absorbability, is capable of being folded in a zigzag fashion through hinges, and is connected at one end thereof to an end of each of the pair of first plate members on the side opposite to the opposed end faces of the first plate members and connected at the other end thereof to a fixing portion in order to intercept other X-rays than the X-ray passing through the aperture.

2. A collimator according to claim 1, wherein the pair of first plate members is movable independently of each other.

3. A collimator according to claim 1, further comprising:

a pair of third plate members having X-ray absorbability, being movable in a direction parallel to surfaces thereof and perpendicular to the moving direction of the first plate members, and having respective end faces opposed to each other, with an X-ray passing aperture being defined by a spacing between the opposed end faces of the third plate members; and a pair of fourth plate members each of which has X-ray absorbability, is capable of being folded in a zigzag fashion through hinges, and is connected at one end thereof to and end of each of the third pair of plate members on the side opposite to the opposed end faces of the third plate members and connected at the other end thereof to a fixing portion in order to intercept other X-rays than the X-ray passing through the aperture.

4. A collimator according to claim 3, wherein the pair of third plate members is movable independently of each other.

5. An X-ray irradiator comprising:

an X-ray tube; and a collimator for collimating X-ray emitted from the X-ray tube, the collimator comprising:

a pair of first plate members having X-ray absorbability, movable in a direction parallel to surfaces thereof, and having respective end faces opposed to each other, with an X-ray passing aperture being defined by a spacing between the opposed end faces of the first plate members; and a pair of second plate members each of which has X-ray absorbability, is capable of being folded in a zigzag fashion through hinges, and is connected at one end thereof to an end of each of the pair of first plate members on the side opposite to the opposed end faces of the first plate members and connected at the other end thereof to a fixing portion in order to intercept other X-rays than the X-ray passing through the aperture.

6. An X-ray irradiator according to claim 5, wherein the pair of first plate members is movable independently of each other.

7. An X-ray irradiator according to claim 5, wherein the collimator further comprises:

a pair of third plate members having X-ray absorbability, movable in a direction parallel to surfaces thereof and perpendicular to the moving direction of the first plate members, and having respective end faces opposed to each other, with an X-ray passing aperture being defined by a spacing between the opposed end faces of the third plate members; and a pair of fourth plate members each of which has X-ray absorbability, is capable of being folded in a zigzag fashion through hinges, and is connected at one end thereof to and end of each of the third pair of plate members on the side opposite to the opposed end faces of the third plate members and connected at the other end thereof to a fixing portion in order to intercept other X-rays than the X-ray passing through the aperture.

8. An X-ray irradiator according to claim 7, wherein the pair of third plate members is movable independently of each other.

9. An X-ray apparatus comprising:

an X-ray tube;

a collimator for collimating X-ray emitted from the X-ray tube and applying the collimated X-ray to an object to be radiographed; and a detector device for detecting the X-ray which has passed through the object to be radiographed, the collimator comprising:

a pair of first plate members having X-ray absorbability, movable in a direction parallel to surfaces thereof, and having respective end faces opposed to each other, with an X-ray passing aperture being defined by a spacing between the opposed end faces of the first plate members; and a pair of second plate members each of which has X-ray absorbability, is capable of being folded in a zigzag fashion through hinges, and is connected at one end thereof to an end of each of the pair of first plate members on the side opposite to the opposed end faces of the first plate members and connected at the other end thereof to a fixing portion in order to intercept other X-rays than the X-ray passing through the aperture.

10. An X-ray apparatus according to claim 9, wherein the pair of first plate members is movable independently of each other.

11. An X-ray apparatus according to claim 9, wherein the collimator further comprises:

a pair of third plate members having X-ray absorbability, being movable in a direction parallel to surfaces thereof and perpendicular to the moving direction of the first plate members, and having respective end faces opposed to each other, with an X-ray passing aperture being defined by a spacing between the opposed end faces of the third plate members; and a pair of fourth plate members each of which has X-ray absorbability, is capable of being folded in a zigzag fashion through hinges, and is connected at one end thereof to and end of each of the third pair of plate members on the side opposite to the opposed end faces of the third plate members and connected at the other end thereof to a fixing portion in order to intercept other X-rays than the X-ray passing through the aperture.

12. An X-ray apparatus according to claim 11, wherein the pair of third plate members is movable independently of each other.

* * * * *

UNITED STATES PATENT AND TRADEMARK OFFICE

CERTIFICATE OF CORRECTION

PATENT NO. : 7,023,962 B2
APPLICATION NO. : 10/982114
DATED : April 4, 2006
INVENTOR(S) : Xu et al.

It is certified that error appears in the above-identified patent and that said Letters Patent is hereby corrected as shown below:

In Claim 3, column 6, line 42, delete “to and end” and insert therefor --to an end--.
In Claim 7, column 7, line 18, delete “to and end” and insert therefor --to an end--.
In Claim 11, column 8, line 27, delete “to and end” and insert therefor --to an end--.

Signed and Sealed this

Seventeenth Day of June, 2008

JON W. DUDAS
*Director of the United States Patent and Trademark Office*